US011205831B2

(12) United States Patent
Zhu et al.

(10) Patent No.: US 11,205,831 B2
(45) Date of Patent: Dec. 21, 2021

(54) ANTENNA ELEMENT AND MANUFACTURING METHOD FOR SAME

(71) Applicant: AAC Technologies Pte. Ltd., Singapore (SG)

(72) Inventors: Jianpeng Zhu, Shenzhen (CN); Hua Jiang, Shenzhen (CN); Lulong Li, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,877

(22) Filed: Aug. 18, 2020

(65) Prior Publication Data

US 2021/0036399 A1 Feb. 4, 2021

Related U.S. Application Data

(63) Continuation of application No. PCT/CN2019/094040, filed on Jun. 30, 2019.

(51) Int. Cl.
*H01Q 1/12* (2006.01)
*H01Q 1/50* (2006.01)

(52) U.S. Cl.
CPC ..... *H01Q 1/12* (2013.01); *H01Q 1/50* (2013.01)

(58) Field of Classification Search
CPC ..... H01Q 1/12; H01Q 1/1207; H01Q 1/1242; H01Q 1/20; H01Q 1/38; H01Q 1/50; H01Q 9/04; H01Q 9/0407; H01Q 9/0414; H01Q 9/045; H01Q 15/14; H01Q 15/141; H01Q 15/142
See application file for complete search history.

(56) References Cited

U.S. PATENT DOCUMENTS 5,294,938 A * 3/1994 Matsuo ..... H01Q 1/3275 343/829
2003/0132885 A1* 7/2003 Kuramoto ..... H01Q 9/36 343/702
2004/0021606 A1* 2/2004 Shigihara ..... H01Q 9/0428 343/700 MS
2006/0017650 A1* 1/2006 Allen ..... H01Q 19/32 343/900
2008/0074327 A1* 3/2008 Noro ..... H01Q 9/0442 343/700 MS
2010/0289705 A1* 11/2010 Shtrom ..... H01Q 15/14 343/702
2017/0250471 A1* 8/2017 Lee ..... H01Q 1/2291
2019/0103682 A1* 4/2019 Thai ..... H01Q 13/16
(Continued)

*Primary Examiner* — Jason Crawford
(74) *Attorney, Agent, or Firm* — W&G Law Group

(57) ABSTRACT

The invention provides an antenna element and a manufacturing method of the antenna element. The antenna element includes a main body and a feeding board. The main body has an insulation bracket and a conductive layer by way of electroplating or lasering. The insulation bracket includes a base, first support legs and second support legs. The conductive layer includes a radiation layer covering the top surface, a coupling layer covering the bottom surface and coupled to the radiation layer, a feeding column layer covering the outer surface of each first support leg and a branch layer covering the outer surface of each second support leg. By virtue of the configuration, it is unnecessary to assemble the main body additionally, so that the consistency of the antenna element is improved.

20 Claims, 3 Drawing Sheets

(56) References Cited

U.S. PATENT DOCUMENTS

| | | | | |
|---|---|---|---|---|
| 2019/0123443 | A1* | 4/2019 | Russell | H01Q 1/1207 |
| 2020/0412002 | A1* | 12/2020 | Li | H01Q 21/065 |
| 2020/0412010 | A1* | 12/2020 | Chu | H01Q 1/38 |

* cited by examiner

ANTENNA ELEMENT AND MANUFACTURING METHOD FOR SAME

FIELD OF THE PRESENT DISCLOSURE

The invention relates to the technical field of communication technologies, in particular to an antenna element and a manufacturing method of the antenna element.

DESCRIPTION OF RELATED ART

The transmission speed of the fifth-generation mobile communication technology (5G) is very fast, which changes existing lifestyles of people greatly, so that the fifth mobile communication technology has been developed quickly in recent years. Antenna technology as a core of 5G has been developed quickly, too. However, it is tedious to operate an existing antenna in an assembling process, which leads to the problem of poor consistency and high cost of the antenna.

Therefore, it is necessary to provide an antenna element to solve the problems of poor consistency and high cost due to tedious assembly of existing antenna.

SUMMARY OF THE INVENTION

One of the main objects of the present invention is to provide an antenna element with stable consistency and lower cost.

Accordingly, the present invention provides an antenna element comprising:

a main body having an insulation bracket including a base with a top surface and a bottom surface opposite to the top surface, first support legs and second support legs protruding from the bottom surface in a spaced manner, and a conductive layer formed on an outer surface of the insulation bracket by way of electroplating or lasering, the conductive layer comprising a radiation layer covering the top surface, a coupling layer covering the bottom surface and coupled to the radiation layer, a feeding column layer covering the outer surface of each first support leg and a branch layer covering the outer surface of each second support leg;

a feeding board electrically connected to the main body; wherein the branch layer is electrically connected to the coupling layer, and the top end of the feeding column layer is electrically connected to the coupling layer; and the bottom end of the feeding column layer is electrically connected to the feeding board.

As an improvement, the base comprises a first substrate and a second substrate overlapped on one side of the first substrate, the top surface is located on the side of the second substrate far away from the first substrate, and the bottom surface is located on the side of the first substrate far away from the second substrate.

As an improvement, the first support legs and the second support legs are cylindrical and both the first support legs and the second support legs extend toward the feeding board from the bottom surface vertically.

As an improvement, an extended distance of the second support leg is smaller than an extended distance of the first support leg; and a distance is formed between the second support leg and the feeding board.

As an improvement, each first support leg comprises a cylinder connected to the bottom surface and an extension part extending toward the feeding board from an end far away from the bottom surface of the cylinder.

As an improvement, the antenna element includes four first support legs and four second support legs; wherein the four first support legs protrude from a middle of the bottom surface in a spaced manner, and the four second support legs are disposed at four corners of the bottom surface.

As an improvement, the feeding board comprises a medium layer and a feeding cable overlapped to one side of the medium layer near the bottom surface, and the feeding column layer is electrically connected to the feeding cable.

As an improvement, the antenna element further comprises a grounding plate arranged on a side of the medium layer far away from the feeding cable.

As an improvement, the insulation bracket is integrally formed by injection molding.

The invention also provides a method for manufacturing the antenna element comprising the steps of integrally manufacturing the insulation bracket through a mold; manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
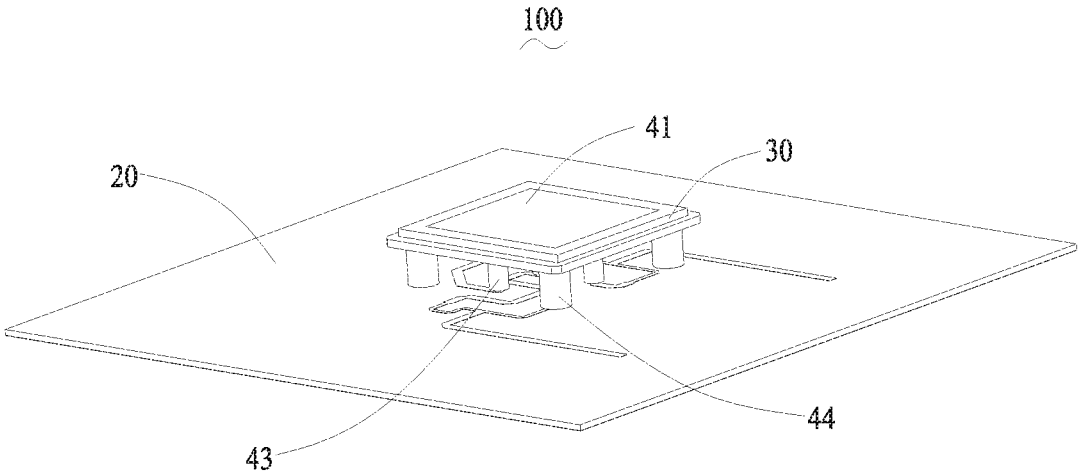
FIG. 1 is an illustration of an antenna element in accordance with an exemplary embodiment of the present invention.

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

It is to be noted that all directional indicators in the embodiments of the invention (for example, upper, lower, left, right, front, back, inner, outer, top, bottom and the like) are only used for explaining relative position relationships among parts in some special gesture (for example, shown in the drawings) and so on. If the special gesture changes, the directional indicators also change correspondingly.

It should also be noted that when an element is referred to as being "fixed" or "disposed" on another element, the element may be directly on the other element or there may be intervening elements at the same time. When an element is called "connected" to another element, it may be directly connected to the other element or there may be intervening elements at the same time.

Figure 2:
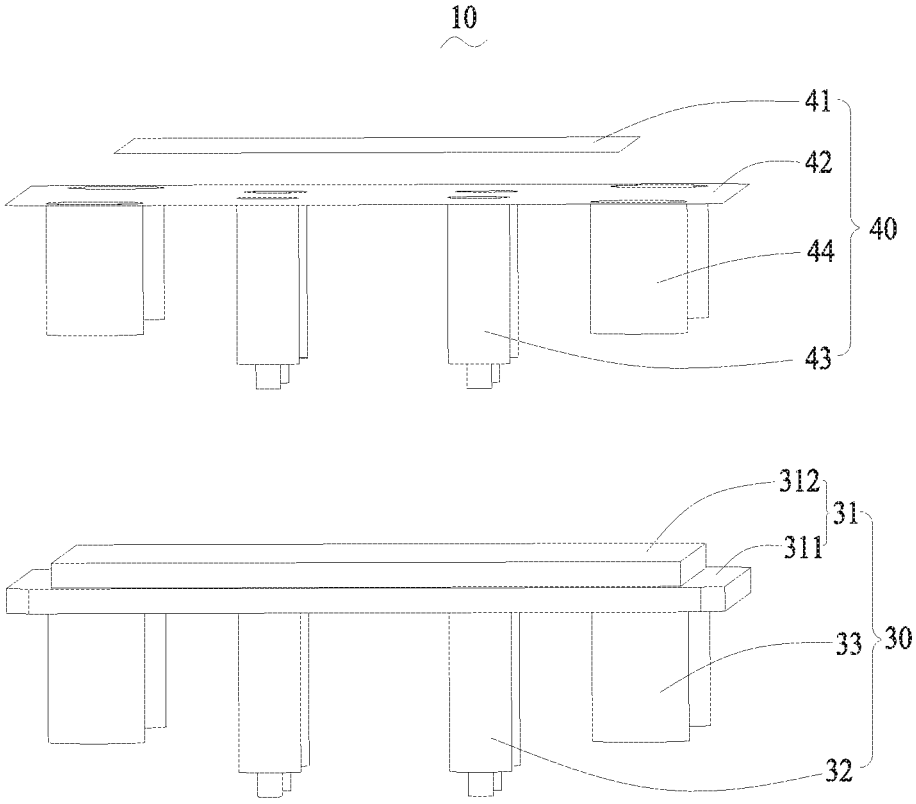
FIG. 2 is an exploded view of a main body of the antenna element.

With reference to FIG. 1 and FIG. 2, an antenna element 100 provided by an embodiment of the invention comprises a main body 10 and a feeding board 20. The main body 10 comprises an insulation bracket 30 and a conductive layer 40. The insulation bracket 30 is integrally formed by injection molding of a mold. The conductive layer 40 is formed on the outer surface of the insulation bracket 30 by way of electroplating or lasering and is electrically connected to the feeding board 20. It can be understood that the insulation bracket 30 can be also separately formed.

Figure 3:
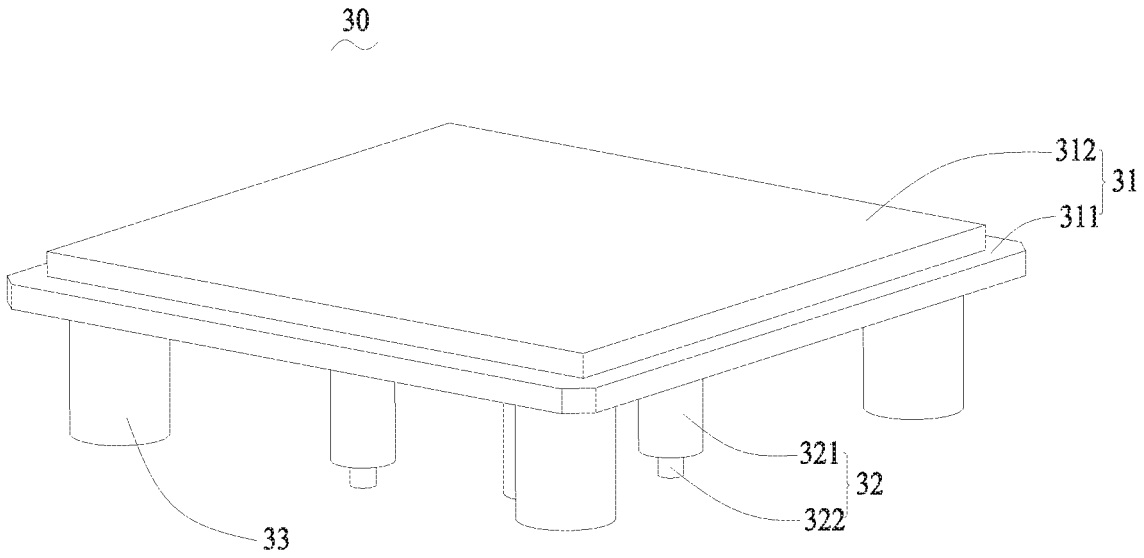
FIG. 3 is an illustration of an insulation bracket of the antenna element.

With reference to FIG. 1 and FIG. 3, the insulation bracket 30 also comprises a base 31, first support legs 32 and second support legs 33. The base 31 comprises a first substrate 311 and a second substrate 312 overlapped to the first substrate 311. The side, far away from the second substrate 312, of the first substrate 311 is the bottom surface. The side, far away from the first substrate 311, of the second substrate 312 is the top surface. The first support legs 32 and the second support legs 33 are vertically connected to the bottom surface and extend toward the direction of the feeding board 20. The extending distances of the second support legs 33 are smaller than the extending distances of the first support legs 32. Each first support leg 32 comprises a cylinder 321 connected to the bottom surface and an extension part 322 extending toward a feeding board 20 from the bottom end of the cylinder 321. The first support legs 32 and the second support legs 33 are preferably, but not limited to, be cylindrical, and preferably, four first support legs 32 and four second support legs 33 are arranged. The four first support legs 32 are arranged in the middle position of the bottom surface of the first substrate 311 in a spaced manner and the four second support legs 33 are arranged at four corners of the first substrate 311. It can be understood that the quantity, positions and sizes of the second support legs 33 can be adjusted according to actual condition.

With reference to FIG. 1, FIG. 2 and FIG. 3, The conductive layer 40 comprises a radiation layer 41, a coupling layer 42, a feeding column layer 43 and a branch layer 44. The radiation layer 41 is formed on the top surface by way of electroplating or lasering, the coupling layer 42 is formed on the bottom surface by way of electroplating or lasering, the radiation layer 41 and the coupling layer 42 are coupled and can radiate electromagnetic waves, the feeding column layer 43 is formed on the outer surface of each first supporting leg 32 by way of electroplating or lasering, the branch layer 44 is formed on the outer surface of each second support leg 33 by way of electroplating or lasering, the top end and the bottom end of the feeding column layer 43 are electrically connected to the coupling layer 42 and the feeding board 20, separately, and the branch layer 44 is electrically connected to the coupling layer 42 and the feeding column layer 43.

As the radiation layer 41, the coupling layer 42, the feeding column layer 43 and the branch layer 44 are formed on the outer surface of the insulation bracket 30 by way of electroplating or lasering, it is unnecessary to assemble the main body 10 of the antenna element additionally, so that the labor cost is lowered. As the coupling layer 42 and the feeding column layer 43 are not transitional apparently, the consistency of the antenna element 100 is improved, and the performance of the antenna element 100 is more stable and reliable.

Figure 4:
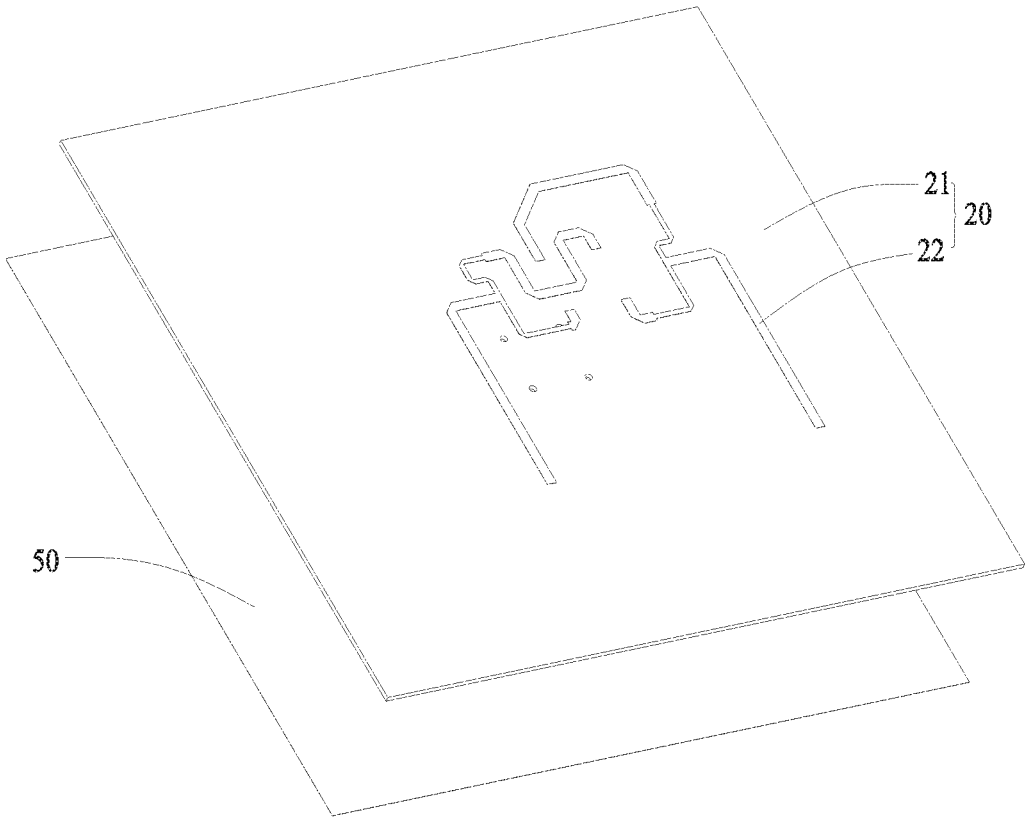
FIG. 4 is an exploded view of a feeding board and a grounding plate of the antenna element.
Figure 5:
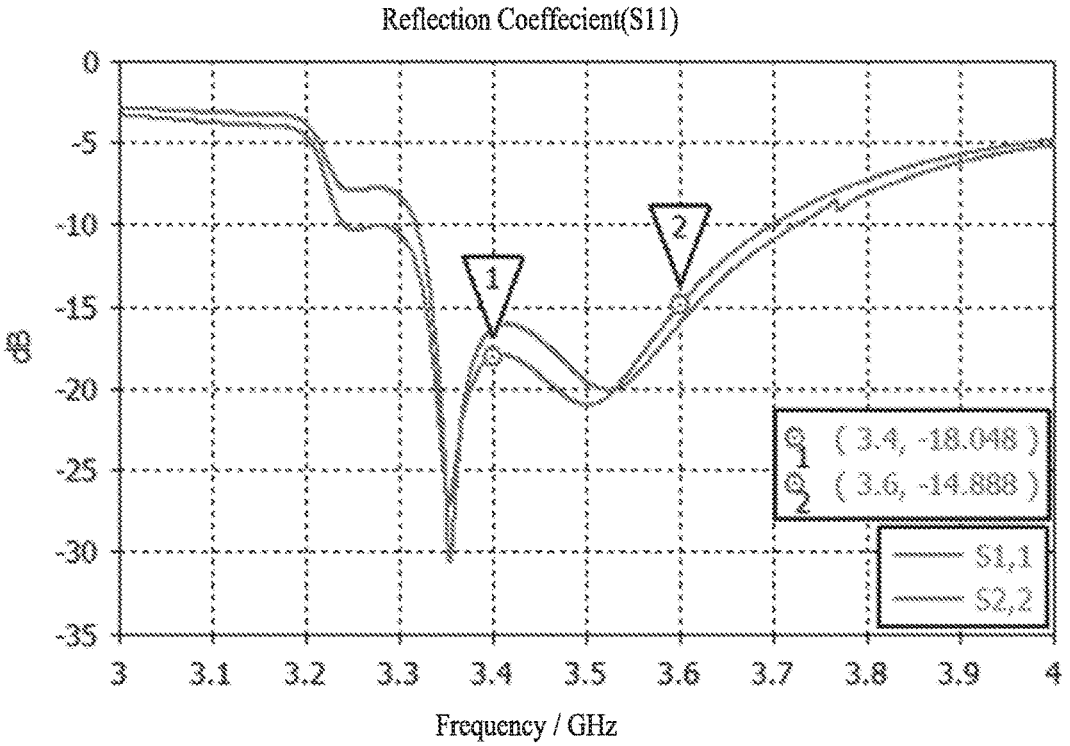
FIG. 5 shows a relationship of reflection coefficient and frequency of the antenna element of the present invention.
Figure 6:
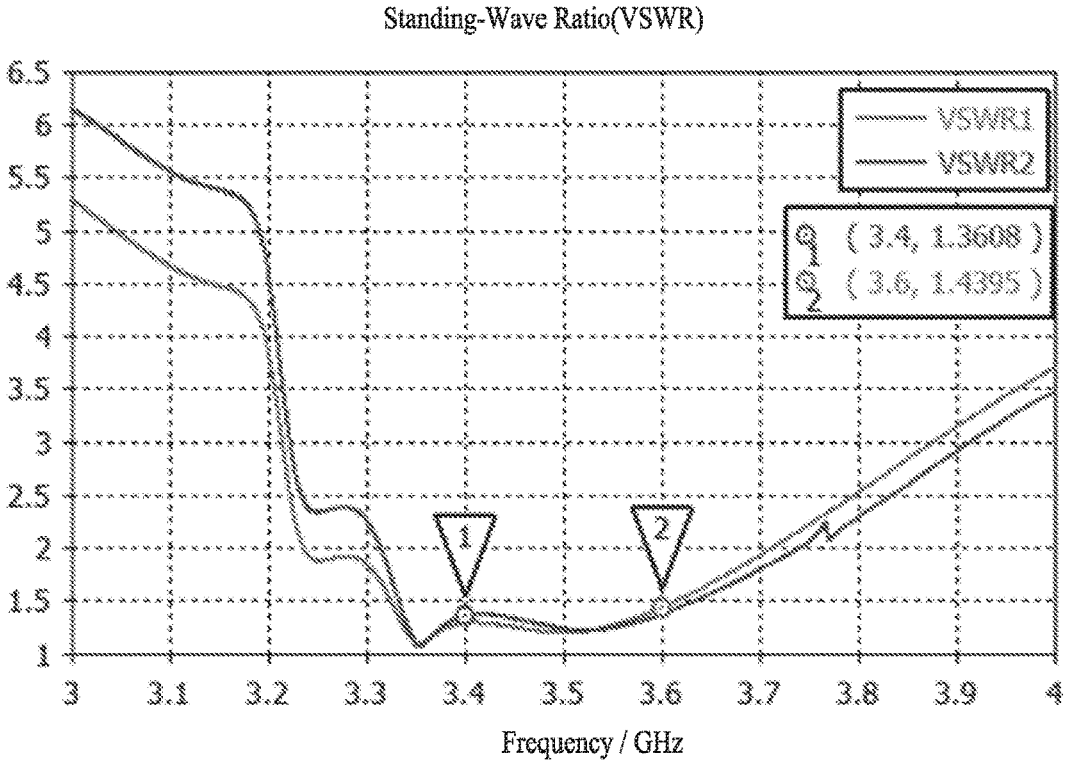
FIG. 6 shows a relationship of standing-wave ratio and frequency of the antenna element.

With reference to FIG. 1, FIG. 2 and FIG. 4, the feeding board 20 comprises a medium layer 21 and a feeding cable 22 overlapped to the side of the medium layer 21 near the bottom surface, and a feeding column layer 43 located on an extension part 322 of each first support leg 32 is electrically connected to the feeding cable 22. The antenna element 100 further comprises a grounding plate 50. The grounding plate 50 is located on the side, far away from the feeding cable 22, of the medium layer 21. The grounding plate 50 further plays a role of a reflection plate, so that the radiation parameter of the antenna element 100 is improved favorably.

With reference to FIG. 1 and FIG. 3, as a separation distance exists between the tail end of each second support leg 33 and the grounding plate 50, that is, a separation distance exists between the tail end of the branch layer 44 on each second support leg 33 and the grounding layer 50. A capacitance effect is formed between the branch layer 44 and the grounding plate 50, so that the working band of the antenna element 100 is expanded to a lower frequency stage. The band of the antenna element 100 is expanded, it is favorable to miniaturize the antenna element 100, and the practicality of the antenna element 100 is improved. Moreover, the profile height of the antenna element 100 can be also reduced. The profile height of a conventional antenna element is about 20 mm and the profile height of the antenna element 100 in the invention can be smaller than 10 mm.

The invention further provides a manufacturing method of the antenna element 100, comprising the following steps:

manufacturing an insulation bracket 30 integrally by means of a mold;

separately manufacturing and forming a radiation layer 41 covering the top surface, a coupling layer 42 covering the bottom surface, a feeding column layer 43 covering the outer surface of each first support leg 32 and a branch layer 44 covering the outer surface of each second support leg 33 on the outer surface of the insulation bracket 30 by way of electroplating or lasering to manufacture a main body 10 of the antenna element;

and mounting the main body 10 of the antenna element on a feeding board 20. The main body 10 of the antenna element in the embodiments is preferably mounted on the feeding board 20 by way of welding.

The invention has the beneficial effects that by way of electroplating or lasering. A radiation layer 41 is formed on the top surface, a coupling layer 42 is formed on the bottom surface, a feeding column layer 43 is formed on the outer surface of each first support leg 32, and a branch layer 44 is formed on the outer surface of each second support leg 33, so that it is unnecessary to assemble the a body 10 of the antenna element additionally. Meanwhile, a feeding column layer 43 and the coupling layer 42 are not transitional apparently, so that the consistency of the main body 10 of the antenna element can be improved, and therefore, the performance of the antenna element 100 is more stable and reliable.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A antenna element, comprising:

a main body having an insulation bracket including a base with a top surface and a bottom surface opposite to the top surface, first support legs and second support legs protruding from the bottom surface in a spaced manner, and a conductive layer formed on an outer surface of the insulation bracket by way of electroplating or lasering, the conductive layer comprising a radiation layer covering the top surface, a coupling layer covering the bottom surface and coupled to the radiation layer, a feeding column layer covering the outer surface of each first support leg and a branch layer covering the outer surface of each second support leg;

a feeding board electrically connected to the main body; wherein the branch layer is electrically connected to the coupling layer, and the top end of the feeding column layer is electrically connected to the coupling layer; and the bottom end of the feeding column layer is electrically connected to the feeding board.

2. The antenna element as described in claim 1, wherein the base comprises a first substrate and a second substrate overlapped on one side of the first substrate, the top surface is located on the side of the second substrate far away from the first substrate, and the bottom surface is located on the side of the first substrate far away from the second substrate.

3. The antenna element as described in claim 2, wherein the first support legs and the second support legs are cylindrical and both the first support legs and the second support legs extend toward the feeding board from the bottom surface vertically.

4. The antenna element as described in claim 3, wherein an extended distance of the second support leg is smaller than an extended distance of the first support leg; and a distance is formed between the second support leg and the feeding board.

5. A manufacturing method of an antenna element as described in claim 4, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

6. The antenna element as described in claim 3, wherein each first support leg comprises a cylinder connected to the bottom surface and an extension part extending toward the feeding board from an end far away from the bottom surface of the cylinder.

7. A manufacturing method of an antenna element as described in claim 6, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

8. The antenna element as described in claim 3, wherein the insulation bracket is integrally formed by injection molding.

9. A manufacturing method of an antenna element as described in claim 3, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

10. The antenna element as described in claim 2, wherein the insulation bracket is integrally formed by injection molding.

11. A manufacturing method of an antenna element as described in claim 2, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

12. The antenna element as described in claim 1 including four first support legs and four second support legs; wherein the four first support legs protrude from a middle of the bottom surface in a spaced manner, and the four second support legs are disposed at four corners of the bottom surface.

13. A manufacturing method of an antenna element as described in claim 12, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

14. The antenna element as described in claim 1, wherein the feeding board comprises a medium layer and a feeding cable overlapped to one side of the medium layer near the bottom surface, and the feeding column layer is electrically connected to the feeding cable.

15. The antenna element as described in claim 14, further comprising a grounding plate arranged on a side of the medium layer far away from the feeding cable.

16. A manufacturing method of an antenna element as described in claim 15, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

17. A manufacturing method of an antenna element as described in claim 14, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

18. The antenna element as described in claim 1, wherein the insulation bracket is integrally formed by injection molding.

19. A manufacturing method of an antenna element as described in claim 18, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

20. A manufacturing method of an antenna element as described in claim 1, wherein the method comprises following steps:

integrally manufacturing the insulation bracket through a mold;

manufacturing the radiation layer covering a top surface of the insulation bracket, the coupling layer covering a bottom surface of the insulation bracket, the feeding column layer covering an outer surface of each first support leg, and the branch layer covering an outer surface of each second support leg by way of electroplating or lasering for forming the main body of the antenna element; and mounting the main body of the antenna element on the feeding board.

* * * * *